US009470106B2

(12) United States Patent
Begin et al.

(10) Patent No.: US 9,470,106 B2
(45) Date of Patent: Oct. 18, 2016

(54) TURBO CHARGER COMPRESSOR WITH INTEGRATED BACK PLATE AND BEARING HOUSING

(71) Applicant: GM Global Technology Operations LLC, Detroit, MI (US)

(72) Inventors: Louis P. Begin, Rochester, MI (US); Brian J. Edwards, Macomb, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 899 days.

(21) Appl. No.: 13/764,280

(22) Filed: Feb. 11, 2013

(65) Prior Publication Data

US 2014/0227089 A1 Aug. 14, 2014

(51) Int. Cl.
*F01D 25/16* (2006.01)
*F01D 25/24* (2006.01)

(52) U.S. Cl.
CPC ..... *F01D 25/24* (2013.01); *F01D 25/16* (2013.01); *F05D 2220/40* (2013.01)

(58) Field of Classification Search
CPC ..... F02C 6/12; F02C 7/06; F01D 25/16; F01D 25/162; F01D 25/24; F01D 25/243; F05B 2220/40; F05D 2220/40
See application file for complete search history.

(56) References Cited

U.S. PATENT DOCUMENTS 2,397,703 A * 4/1946 Stallman ..... F16B 21/186 384/538
3,263,424 A * 8/1966 Birmann ..... F01D 25/145 285/330
3,390,926 A 7/1968 Woollenweber, Jr.
3,969,804 A * 7/1976 MacInnes ..... F01D 25/166 29/469
5,230,540 A * 7/1993 Lewis ..... F02K 1/80 285/363
5,549,449 A * 8/1996 McInerney ..... F01D 25/14 384/413
2005/0210875 A1 9/2005 Larue et al.
2008/0019629 A1* 1/2008 McKeirnan ..... F16C 35/077 384/493
2009/0022580 A1* 1/2009 Hall ..... B23P 19/084 415/160
2011/0002770 A1* 1/2011 Bywater ..... F02B 37/16 415/1
2011/0142604 A1* 6/2011 Schumnig ..... F01D 25/24 415/170.1
2015/0037146 A1* 2/2015 Yamaguchi ..... F01D 11/025 415/174.5

FOREIGN PATENT DOCUMENTS

CN 102066718 A 5/2011

* cited by examiner

*Primary Examiner* — Eric Keasel
*Assistant Examiner* — Joshua R Beebe
(74) *Attorney, Agent, or Firm* — Harness, Dickey & Pierce, P.L.C.

(57) ABSTRACT

A turbocharger includes a turbine housing defining a turbine chamber and a compressor housing defining a compressor chamber. A turbine wheel is disposed in the turbine chamber and a turbine shaft is connected to the turbine wheel. A compressor wheel is disposed in the compressor chamber and connected to the turbine shaft. A compressor back plate is adjacent to the compressor wheel and a bearing cartridge is sandwiched directly between the compressor back plate and the turbine housing and rotatably supporting the turbine shaft.

14 Claims, 1 Drawing Sheet

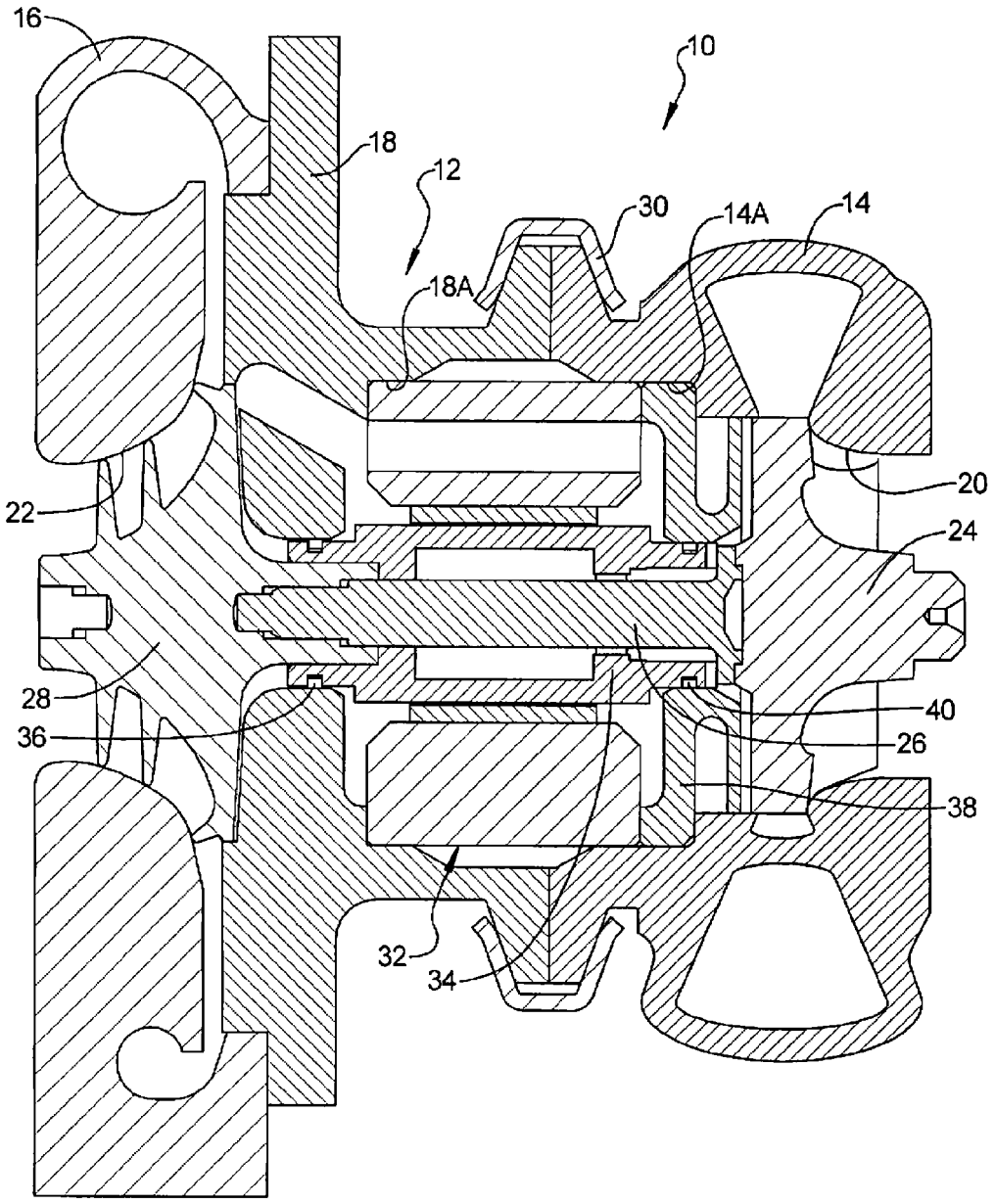
16
10
18
12
30
14A
14
18A
20
22
24
28
40
36
26
38
32
34

TURBO CHARGER COMPRESSOR WITH INTEGRATED BACK PLATE AND BEARING HOUSING

FIELD

The present disclosure relates to turbochargers and more particularly, to a turbocharger compressor with an integrated back plate and bearing housing.

BACKGROUND

This section provides background information related to the present disclosure which is not necessarily prior art.

Turbocharged engines utilize compressed air which results in a larger quantity of air being forced into the engine, creating more power. The energy used to drive the turbo compressor is extracted from waste exhaust gases. As the exhaust gases leave the engine, they are directed through a turbine wheel placed in the exhaust flow. The gases drive the turbine wheel, which is directly connected via a turbine shaft to a compressor wheel. Increased exhaust gas flow drives the turbine wheel faster, providing the engine more air, thereby producing more power. Therefore, the turbocharger uses the extraction of energy from the exhaust gas to improve the engine efficiency.

Turbochargers are usually seen as power enhancement on performance cars, but today, turbochargers are becoming more regularly used to provide greater torque on small capacity engines. The advantages of using a turbocharged engine include improved fuel efficiency and reduced exhaust emissions. The components of the turbocharger generally include a housing defining a compressor chamber and a turbine chamber, a compressor wheel is disposed in the compressor chamber, and a turbine wheel is disposed in the turbine chamber. A turbine shaft is provided for connecting between the turbine wheel and the compressor wheel.

A conventional turbocharger can include a center housing between the turbine housing and a back plate of the compressor. The center housing can support a bearing cartridge for rotatably supporting the turbine shaft. This arrangement requires tight tolerances on all of the housing components in order to precisely control the position of the turbine and compressor wheels relative to the housing components. As the housing components are assembled to one another, the blade tip clearance of the compressor and turbine wheels need to be precisely controlled to provide an efficient turbocharger.

SUMMARY

This section provides a general summary of the disclosure, and is not a comprehensive disclosure of its full scope or all of its features.

The turbocharger of the present disclosure provides a turbocharger with reduced complexity, reduced part count and reduced stack tolerance. The turbocharger includes a turbine housing defining a turbine chamber and a compressor housing defining a compressor chamber. A turbine wheel is disposed in the turbine chamber and a turbine shaft is connected to the turbine wheel. A compressor wheel is disposed in the compressor chamber and connected to the turbine shaft. A compressor back plate is adjacent to the compressor wheel and a bearing cartridge is sandwiched directly between the compressor back plate and the turbine housing and rotatably supporting the turbine shaft.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

The drawing is a cross-sectional view of an exemplary turbocharger according to the principles of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

With reference to the FIGURE, the turbocharger 10 includes a housing 12 including a turbine housing 14, a compressor housing 16, and a compressor backplate 18. The turbine housing 14 defines a turbine chamber 20 and the compressor housing 16 defines a compressor chamber 22. A turbine wheel 24 is disposed in the turbine chamber 20 and a turbine shaft 26 is connected to the turbine wheel 24 and to a compressor wheel 28 that is disposed in the compressor chamber 22. The compressor backplate 18 is connected directly to the turbine housing 14. In particular, the compressor backplate 18 can be connected to the turbine housing 14 by a clamp 30 or alternatively, by threaded fasteners or other connecting means.

A bearing cartridge 32 is sandwiched between the compressor backplate 18 and the turbine housing 14. The turbine housing 14 and compressor backplate 18 each include bearing seat regions 14A, 18A, respectively, that receive the bearing cartridge 32 therein. A bearing shaft 34 is rotatably received in the bearing cartridge 32 and includes a first piston ring seal 36 that engages the compressor backplate 18. A heat shield 38 is provided between the turbine wheel 24 and the bearing cartridge 32. The heat shield 38 can be fixed in the recessed cavity defining the bearing seat 14A of the turbine housing 14, and can include a second piston ring seal 40 that seals between the bearing shaft 34 and the heat shield 38. The bearing cartridge 32 can be press fit into the turbine housing 14 and compressor backplate 18. The bearing shaft 34 is received in the bearing cartridge 32 and the turbine shaft 26 extends through the bearing shaft 34. This turbine shaft 26 may be welded or joined to the turbine wheel 24 and is connected to the compressor wheel 28 typically by threading or utilizing a threaded fastener. Sandwiched in between the turbine wheel 24 and shaft 26, and the compressor wheel 28 can be a bearing shaft 34 supported radially by the turbine shaft 26.

With the design of the present disclosure, the bearing cartridge radially pilots the bearing shaft 34 and the turbine shaft 26 and is supported between the turbine housing 14 and the compressor backplate 18. The design allows the elimination of the center housing so that the problem with stacked tolerances is eliminated, as only one stack is utilized. The design reduces the complexity, part count, and tolerance stack.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A turbocharger comprising:

a one-piece turbine housing defining a turbine chamber;

a compressor housing defining a compressor chamber;

a turbine wheel disposed in said turbine chamber;

a turbine shaft connected to said turbine wheel;

a compressor wheel disposed in said compressor chamber and connected to said turbine shaft;

a compressor back plate adjacent to said compressor wheel; and a bearing cartridge sandwiched directly between said compressor back plate and said turbine housing and rotatably supporting said turbine shaft, wherein said compressor back plate and said turbine housing each include a recess into which said bearing cartridge is press-fit, wherein said compressor back plate is connected directly to said turbine housing.

2. The turbocharger according to claim 1, wherein said compressor back plate is connected to said turbine housing by a clamp.

3. The turbocharger according to claim 1, further comprising a bearing shaft between said turbine shaft and said bearing cartridge.

4. The turbocharger according to claim 1, further comprising a seal disposed between bearing shaft and said compressor back plate.

5. The turbocharger according to claim 1, further comprising a heat shield disposed between said turbine wheel and said bearing cartridge.

6. The turbocharger according to claim 5, further comprising a seal disposed between said bearing shaft and said heat shield.

7. The turbocharger according to claim 1, wherein said bearing cartridge is partially received in each of said compressor back plate and said turbine housing.

8. A turbocharger comprising:

a one-piece turbine housing defining a turbine chamber;

a compressor housing defining a compressor chamber;

a turbine wheel disposed in said turbine chamber;

a turbine shaft connected to said turbine wheel;

a compressor wheel disposed in said compressor chamber and connected to said turbine shaft;

a compressor back plate mounted to said compressor housing adjacent to said compressor wheel, said compressor back plate being connected directly to said turbine housing; and a bearing cartridge received at least partially in said compressor back plate and in said turbine housing, said bearing cartridge rotatably supporting said turbine shaft.

9. The turbocharger according to claim 8, wherein said compressor back plate and said turbine housing each includes a recess into which said bearing cartridge is press-fit.

10. The turbocharger according to claim 8, wherein said compressor back plate is connected to said turbine housing by a clamp.

11. The turbocharger according to claim 8, further comprising a bearing shaft between said turbine shaft and said bearing cartridge.

12. The turbocharger according to claim 11, further comprising a seal disposed between said bearing shaft and said compressor back plate.

13. The turbocharger according to claim 8, further comprising a heat shield disposed between said turbine wheel and said bearing cartridge.

14. The turbocharger according to claim 13, further comprising a seal disposed between said bearing shaft and said heat shield.

* * * * *